US009085942B2

(12) United States Patent
Hashem et al.

(10) Patent No.: US 9,085,942 B2
(45) Date of Patent: Jul. 21, 2015

(54) REPAIRED WEAR AND BUCKLE RESISTANT DRILL PIPE AND RELATED METHODS

(75) Inventors: Ghazi J. Hashem, Seabrook, TX (US); David Brunnert, Cypress, TX (US); John W. Kochera, Conroe, TX (US); Mark Mitchell, Pearland, TX (US); Melissa A. Frilot, Houston, TX (US); Thomas M. Redlinger, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 633 days.

(21) Appl. No.: 13/413,311

(22) Filed: Mar. 6, 2012

(65) Prior Publication Data

US 2013/0098690 A1 Apr. 25, 2013

Related U.S. Application Data

(63) Continuation-in-part of application No. 13/278,403, filed on Oct. 21, 2011.

(51) Int. Cl.
*E21B 17/10* (2006.01)
*E21B 29/00* (2006.01)

(52) U.S. Cl.
CPC ..... *E21B 17/1085* (2013.01); *E21B 17/10* (2013.01); *E21B 29/00* (2013.01)

(58) Field of Classification Search
CPC ..... E21B 43/103; E21B 43/106; E21B 29/10; E21B 17/08; E21B 17/10; E21B 29/00; Y10T 29/4994; Y10T 29/49911; Y10T 29/53552; Y10T 24/1441; Y10T 29/49732; B21D 39/04; F16L 41/06; F16L 55/172; F16L 55/1651; F16L 55/18; F16K 43/00; B29C 65/00
USPC ..... 166/277, 377, 384, 207, 206; 285/15; 137/15.01–15.26, 315.01–329.4; 138/97–99
See application file for complete search history.

(56) References Cited

U.S. PATENT DOCUMENTS

| | | | | |
|---|---|---|---|---|
| 2,259,023 | A | 10/1941 | Clark | |
| 2,295,873 | A | 9/1942 | Stone | |
| 2,330,933 | A | 10/1943 | Terrell, Jr. | |
| 3,067,593 | A * | 12/1962 | McCool | 464/183 |
| 3,080,179 | A | 3/1963 | Huntsinger | |
| 3,682,256 | A | 8/1972 | Stuart | |
| 3,773,359 | A | 11/1973 | Chance et al. | |
| 3,784,238 | A | 1/1974 | Chance et al. | |

(Continued)

OTHER PUBLICATIONS

RDT, "Wear Knot Drill Pipe Features and Benefits", www.rdt-usa.com.

(Continued)

*Primary Examiner* — Shane Bomar
*Assistant Examiner* — Wei Wang
(74) *Attorney, Agent, or Firm* — Patterson & Sheridan LLP

(57) ABSTRACT

The present invention embodies a drill pipe in which various damaged sections of the pipe are repaired in order to maintain or improve the wear and buckle resistance of the drill pipe. The sections are strengthened using various hardening methods such as heat treatment processes and/or expansion techniques. A sleeve can also be applied to the strengthened portions. Surface enhancers, such as hardbanding, can be applied to the strengthened portions or the sleeve in order to provide abrasion resistance or to reduce friction.

30 Claims, 2 Drawing Sheets

(56) References Cited

U.S. PATENT DOCUMENTS

| | | | | |
|---|---|---|---|---|
| 4,416,476 | A | 11/1983 | Garrett | |
| 4,460,202 | A | 7/1984 | Chance et al. | |
| 4,987,961 | A | 1/1991 | McNeely | |
| 5,148,876 | A | 9/1992 | Wilson | |
| 5,165,491 | A | 11/1992 | Wilson | |
| 5,332,049 | A | 7/1994 | Tew | |
| 5,713,423 | A | 2/1998 | Martin et al. | |
| 5,853,199 | A | 12/1998 | Wilson | |
| 6,012,744 | A | 1/2000 | Wilson et al. | |
| 6,352,107 | B1 | 3/2002 | Bennett et al. | |
| 6,457,532 | B1 | 10/2002 | Simpson | |
| 6,758,499 | B1 * | 7/2004 | Belew et al. | 285/15 |
| 7,040,422 | B2 | 5/2006 | Springer | |
| 7,182,160 | B2 | 2/2007 | Boulet | |
| 7,487,840 | B2 | 2/2009 | Gammage et al. | |
| 7,810,573 | B2 | 10/2010 | Baird | |
| 7,814,996 | B2 | 10/2010 | Indrupskiy et al. | |
| 8,286,715 | B2 | 10/2012 | Bailey et al. | |
| 8,561,707 | B2 | 10/2013 | Jin et al. | |
| 2002/0185188 | A1 | 12/2002 | Quigley et al. | |
| 2008/0035328 | A1 | 2/2008 | Hill et al. | |
| 2010/0038404 | A1 | 2/2010 | Lingnau et al. | |
| 2010/0044110 | A1 | 2/2010 | Bangru et al. | |
| 2010/0230167 | A1 | 9/2010 | Nichols et al. | |
| 2012/0306199 | A1 | 12/2012 | David | |
| 2013/0056225 | A1 | 3/2013 | Pabon et al. | |
| 2013/0112481 | A1 | 5/2013 | Wang | |

OTHER PUBLICATIONS

RDT, "Wear Knot Drill Pipe Technical Description", www.rdt-usa.com.

Wear Sox, "Twin Wire ARC Thermal Spray Process", www.wearsox.com.

Attachment B: Sinusoidal Buckling and Countermeasures, "Special Downhole Tools to Improve Drillpipe Stiffness", K&M Technology Group, Drilling Design and Implementation for Extended Reach and Complex Wells, 3rd Edition, 2003, p. 126-131.

Canadian Office Action for Patent Application No. 2,791,599; dated Jul. 3, 2014; 2 pages.

* cited by examiner

REPAIRED WEAR AND BUCKLE RESISTANT DRILL PIPE AND RELATED METHODS

PRIORITY

This application is a continuation-in-part of and claims priority to U.S. non-provisional application Ser. No. 13/278,403 entitled, "WEAR AND BUCKLE RESISTANT DRILL PIPE," filed Oct. 21, 2011, naming Ghazi J. Hashem, John W. Kochera, Melissa A. Frilot, and Thomas M. Redlinger as inventors, the disclosure of which is hereby incorporated by reference in its entirety.

FIELD OF THE INVENTION

The present invention relates generally to wellbore tubulars and, more specifically, to methods by which a drill pipe is repaired while, at the same time, enhancing the wear and buckle resistance of the drill pipe.

BACKGROUND

Drilling activity in hard and tight Shale formations has increased substantially in the last few years. The wells that are drilled in these formations are generally very deep and complex. They can be comprised of depths that may exceed 10,000 feet vertically and 10,000 feet in the lateral section of the well.

During the drilling operation of these wells, which may include, but are not limited to, tripping in and tripping out of the well, sliding, rotation, etc., the drill pipe is subjected to high compressive loads that could cause severe buckling of the drill pipe. The buckling could manifest itself as Helical Buckling in the vertical section and/or Sinusoidal Buckling in the lateral section. Sinusoidal buckling occurs when the axial force on a long column, in this case drill pipe, exceeds the critical buckling force and the pipe elastically deforms or bends and takes on a snake-like shape in the hole. Additional compressive loads cause Sinusoidal buckling to transition to Helical Buckling, and take on a corkscrew-like shape in the hole. As such, Helical Buckling is more severe and occurs after Sinusoidal budding. In addition to buckling, the drill pipe may exhibit severe abrasion on one side of the tool joint following the failure of the hardbanding, which will lead to wall thickness loss at the tool joint and/or washouts at the middle section of the tubes.

Ultimately, due to the severe drilling environment in downhole wells, the useful life of the drill pipe is severely shortened. To combat this problem, a wear and buckle resistant drill pipe was developed and disclosed in co-pending non-provisional application Ser. No. 13/278,403, entitled "WEAR AND BUCKLE RESISTANT DRILL PIPE," which is the parent of the present application and also owned by the Assignee of the present invention, Weatherford/Lamb, Inc., of Houston, Tex.

However, after down hole operations, even a buckle resistant drill pipe can be downgraded to scrap as a result of wear. In view of the foregoing, there is a need in the art for a method by which the drill pipe can be repaired and/or enhanced, thereby further extending the useful life of the drill pipe and providing a drill pipe having increased wear and buckle resistance.

SUMMARY OF THE INVENTION

The present invention provides a repaired drill pipe in which various damaged sections of the pipe have been repaired in order to maintain or improve the wear and buckle resistance of the drill pipe. In a first embodiment, a replacement tubular of the drill pipe undergoes a hardening process that results in that portion being strengthened. The hardening process can be, for example, a through wall heat treatment or a surface heat treatment such as a carburizing, nitriding, carbonitriding, flame hardening or chromizing process. In another embodiment, the damaged section is removed and portions of the drill pipe adjacent the damaged section are expanded. Thereafter, the replacement tubular is connected. In the alternative, a sleeve can be applied to the replacement tubular in which a surface enhancer could be applied to the surface of the sleeve or the sleeve surface itself can undergo the hardening process.

DESCRIPTION OF ILLUSTRATIVE EMBODIMENTS

Illustrative embodiments and related methodologies of the present invention are described below as they might be employed in repairing a drill pipe. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methodologies of the invention will become apparent from consideration of the following description and drawings.

Figure 1:
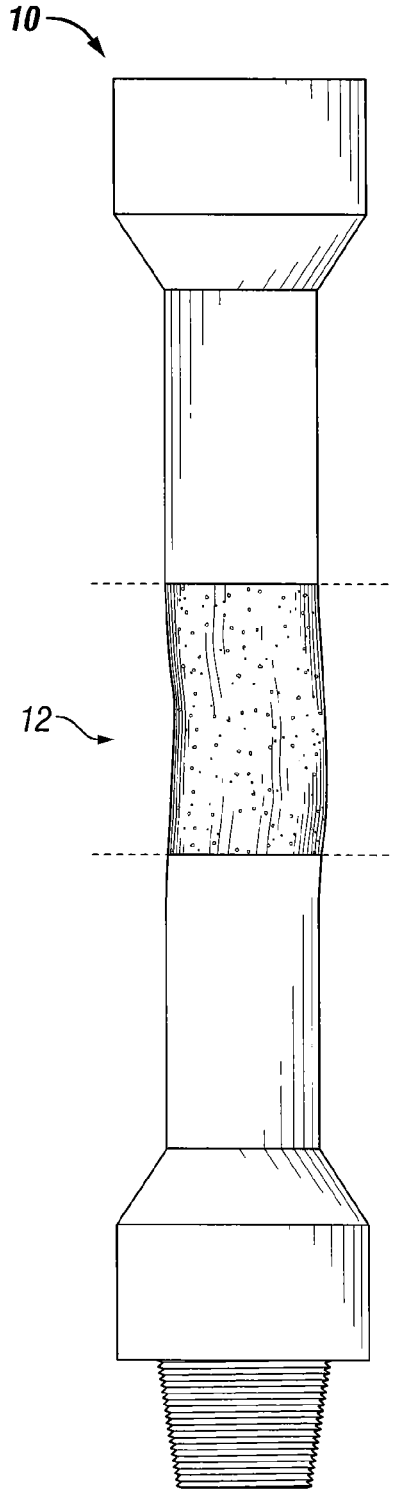
FIG. 1 (Prior Art)
FIG. 1 illustrates a worn drill pipe according to an exemplary methodology of the present invention.

FIG. 1 illustrates a worn drill pipe 10 according to an exemplary embodiment of the present invention. Drill pipe 10 comprises male and female ends and is made of steel, or some other suitable material, as understood in the art. Section 12 was damaged during down hole operations and, using the present invention, will be repaired. Although only one section is shown as damaged in FIG. 1, those ordinarily skilled in the art having the benefit of this disclosure realize the damage could be located at a variety of sections along the drill pipe.

Figure 2:
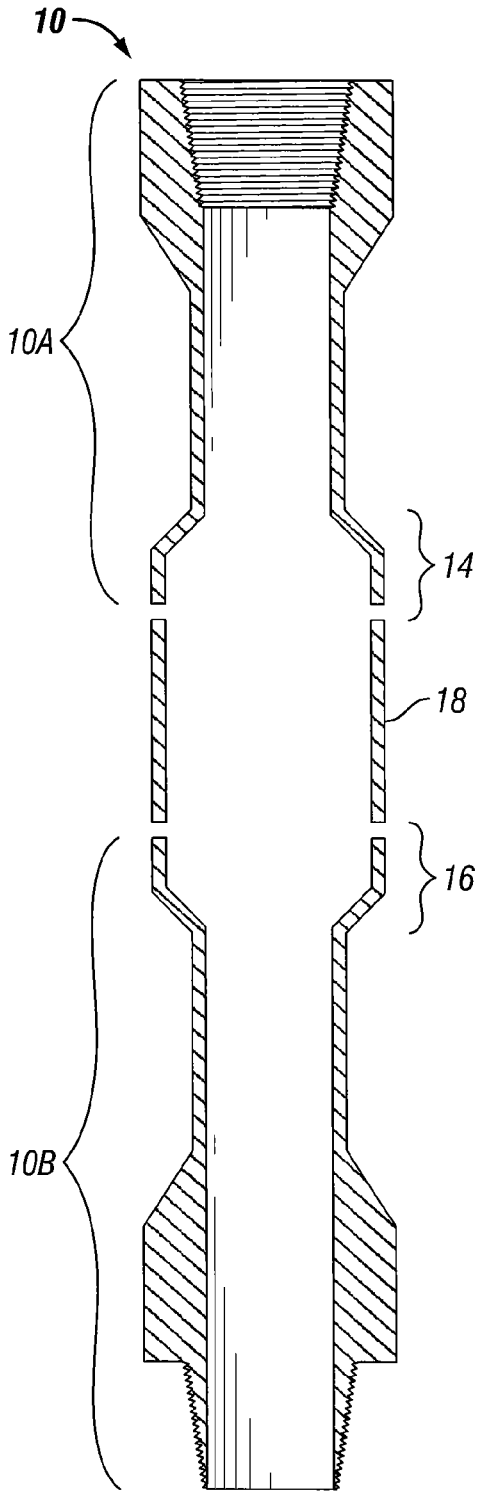
FIG. 2 illustrates the worn drill pipe of FIG. 1 having a cut and expanded section according to an exemplary methodology of the present invention.

In an exemplary embodiment and methodology of the present invention illustrated in FIG. 2, damaged section 12 of drill pipe 10 has been removed using any suitable method known in the art. In this exemplary embodiment, damaged section 12 is in the range of 10-15 feet. However, those ordinarily skilled in the art having the benefit of this disclosure realize the length of removed damaged section 12 may be any length as desired. After section 12 is removed, worn drill pipe 10 now has an upper portion 10A and a lower portion 10B. Upper portion 10A has a lower end 14, while lower portion 10B has an upper end 16.

Next, lower and upper ends 14,16 are expanded using any known tubular expansion method. An exemplary expansion technique is the technique disclosed in U.S. Pat. No. 6,457,532, entitled "PROCEDURES AND EQUIPMENT FOR PROFILING AND JOINTING OF PIPES," issued on Oct. 1, 2002, naming Neil Simpson as inventor, which is owned by the Assignee of the present invention, Weatherford/Lamb, Inc., of Houston, Tex., and is hereby incorporated by reference in its entirety. In this embodiment, the outer diameter of lower and upper ends 14,16 are expanded in the range of 15-20%, although other ranges may be utilized as desired. Those ordinarily skilled in the art having the benefit of this disclosure realize other expansion methods may be utilized, such as pushing a shaped cone to force ends 14,16 outward.

Figure 3:
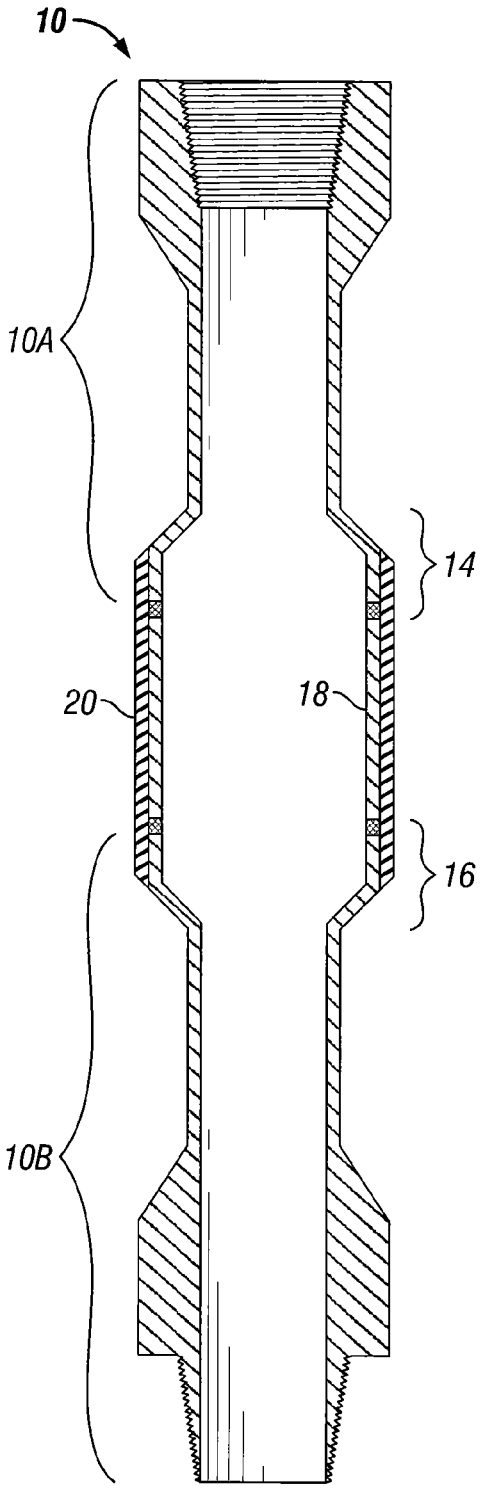
FIG. 3 illustrates a repaired drill pipe according to an exemplary methodology of the present invention.

Next, still referring to FIG. 2, a tubular 18, whose diameter and wall thickness approximates that of the expanded ends 14,16, is placed between expanded end 14 and 16. The length of tubular 18 may be varied as desired. Thus, during the repair process, a Range II product might be converted to Range I or Rangel III category product, as defined by the API and understood in the art. In this exemplary embodiment, tubular 18 is rounded and may be comprised of the same material as that of the drill pipe, or it may be comprised of a material that exhibits increased wear resistance. However, in the alternative, tubular 18 may be a different shape, such as hexagonal or elliptical. Next, as shown in FIG. 3, tubular 18 is connected to expanded ends 14,16 using any suitable technique, such as welding. An exemplary welding technique is the clean electric induction method developed by SPINDUCTION WELD, INC. in U.S. Patent Publication No. 2010/0038404, entitled "Apparatus for Inction Friction Solid State Welding," which is hereby incorporated by reference in its entirety. However, as understood by those ordinarily skilled in the art having the benefit of this disclosure, other suitable welding techniques may be utilized.

Using the exemplary clean induction method mentioned above, expanded ends 14,16 and tubular 18 are heated and, upon reaching the desired temperature, are forced together and slight rotation is applied. Upon generating the weld and while ends 14,16 and tubular 18 are still hot, an axial tension force is applied and the inside and outside rams horns, as understood in the art, are eliminated leaving a clean weld with a wall thickness that approximates that of the wall thickness of expanded ends 14,16.

After tubular 18 is connected to expanded ends 14,16, drill pipe 10 has been repaired. As previously mentioned, the material which makes up tubular 18 may be comprised of the same material as that of the drill pipe 10 or some other wear resistive material, as would be readily understood by one ordinarily skilled in the art having the benefit of this disclosure. In addition, tubular 18 may be hardened using a variety of methods such as, for example, quenching/tempering or the application of surface enhancers, such as alloy sprays or hardbanding material. In the alternative, a wear resistant sleeve 20 may be also be applied to the outer diameter of tubular 18. Each hardening process, and the application of sleeve 20, are disclosed in co-pending parent application Ser. No. 13/278,403 (U.S. Pat. Pub. No. 2013/0098687 A1). Moreover, tubular section 18 may also include friction reduction components such as, for example, rollers, fins to propel cuttings, or sensors for detecting one or more wellbore parameters. One ordinarily skilled in this art having the benefit of this disclosure realize such methods utilized and combined as desired.

Figure 4:
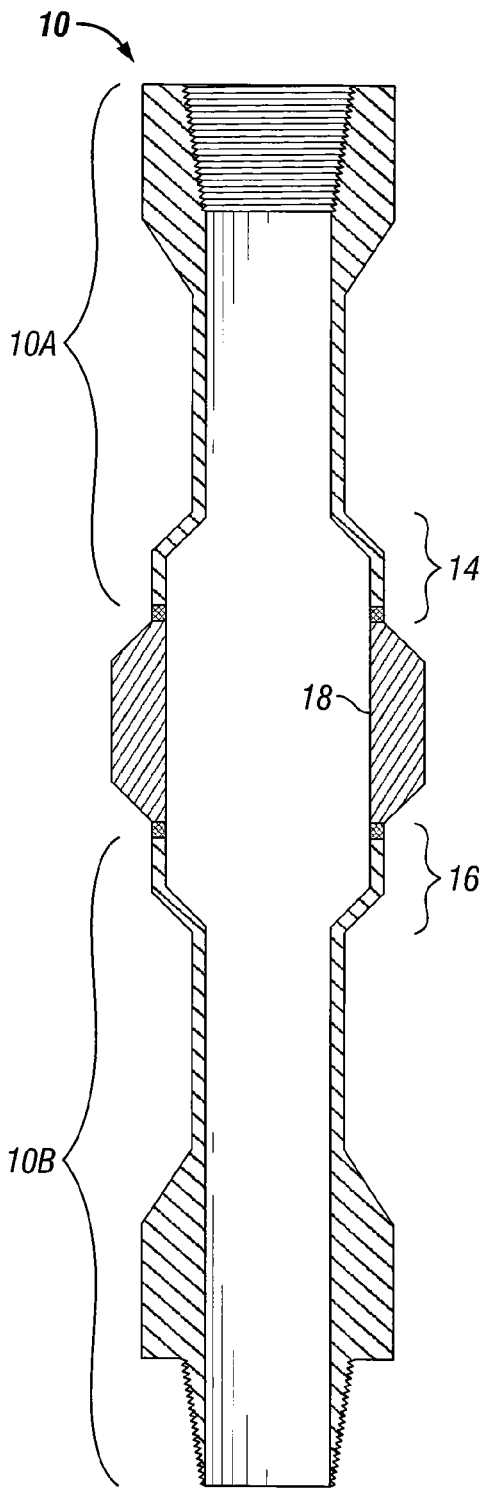
FIG. 4 illustrates a repaired drill pipe according to an alternative exemplary methodology of the present invention.

Referring to FIG. 4, an alternative exemplary embodiment of the present invention is illustrated. As with previous embodiments, the inner diameter of tubular 18 which equals the inner diameter of expanded ends 14,16. However, in this embodiment, tubular 18 is thicker than in previous embodiments, resulting in an outside diameter which is larger than that of expanded ends 14,16. Tubular 18 may be made from suitable materials that match or exceed the strength of the material of drill pipe 10, which exhibit increased wear resistance. Moreover, any of the previously mentioned hardening processes/sleeves may be applied to this embodiment as well. As a result, the wear and buckle resistance of drill pipe 10 is increased. In addition, tubular 18 of FIG. 4 may also be round or some other shape which can be created using an expansion technique such as, for example, the one mentioned previously herein.

An alternative embodiment of the present invention would include the process as previously described, except that no expansion would be used. Thus, the damaged section 12 of drill pipe 10 would be removed and replaced with replacement tubular 18. However, no expansion of ends 14,16 would take place. Thereafter, the hardening processes/sleeve previously described may be applied to replacement tubular 18, as would be understood by one ordinarily skilled in the art having the benefit of this disclosure.

Note also that it is not necessary for the added tubular 18 to be affixed to "matched sets" of box and pin. The embodiments and methodologies disclosed herein may result in mixed streams of box and pins ends suitable for reassembly. Moreover, the outside diameter of tubular 18 or sleeve 20, when utilized, may be grooved axially, spirally, or another adequate shape, to improve the fluid flow and to assist in the removal of cuttings that have resulted from drilling operations. Furthermore, more than one section of drill pipe 10 may be repaired.

The worn tools joints may be repaired using conventional methods. Accordingly, utilizing the present invention, the end result is a repaired and/or modified drill pipe with performance properties that may exceed that of the original drill pipe.

An exemplary methodology of the present invention provides a method of repairing a drill pipe having a tubular body extending between a first and second joint of the drill point, the method comprising the steps of: removing a damaged section of the tubular body, thus resulting in an upper drill pipe portion and a lower drill pipe portion; expanding a lower end of the upper drill pipe portion; expanding an upper end of the lower drill pipe portion; and connecting a replacement tubular between the upper and lower drill pipe portions. Another methodology further comprises the step of hardening the replacement tubular. In yet another methodology, the hardening process comprises at least one of a through wall heat treatment or a surface treatment such as a carburizing, nitriding, carbonitriding, flame hardening or chromizing process.

Yet another methodology further comprises the step of applying a surface enhancer on an outer surface of the hardened replacement tubular. In yet another, the surface enhancer is at least one of a friction-reducing material or a abrasion-resistant material. Another further comprising the step of affixing a sleeve atop the replacement tubular. In yet another methodology, the step of connecting the replacement tubular comprises the step of utilizing a clean induction welding method to connect the replacement tubular. In another, an outer diameter of the replacement tubular is larger than an outer diameter of the expanded upper and lower ends of the drill pipe portions.

An alternative exemplary methodology of the present invention provides a method of repairing a drill pipe having a tubular body extending between a first and second joint of the drill point, the method comprising the steps of: removing a damaged section of the tubular body, thus resulting in an upper drill pipe portion and a lower drill pipe portion; and connecting a replacement tubular between the upper and lower drill pipe portions. Yet another methodology further comprises the step of performing a hardening process on the replacement tubular. Another methodology further comprises the step of applying a surface enhancement to an outer surface of the replacement tubular. In another methodology, the hardening process is at least one of a through wall heat treatment or a surface treatment such as a carburizing, nitriding, carbonitriding, flame hardening or chromizing process. Yet another further comprises the step of affixing a sleeve atop the replacement tubular. Another methodology further comprises the step of applying a surface enhancer on an outer surface of the sleeve. Another comprising the step of performing a hardening process on the sleeve, thereby resulting in a hardened sleeve. In yet another, an outer diameter of the replacement tubular is larger than an outer diameter of the upper and lower drill pipe portions.

An exemplary embodiment of the present invention provides a repaired drill pipe comprising: a first joint located on an upper end of the drill pipe; a second joint located on a lower end of the drill pipe; a tubular body extending between the first and second joints, the tubular body comprising: an upper portion extending beneath the first joint; a replacement tubular extending beneath the upper portion, the replacement tubular replacing a damage section of the drill pipe; and a lower portion extending beneath the replacement tubular, wherein a portion of the replacement tubular comprises hardened material, while the first and second joints and the upper and lower portions of the drill pipe comprise a softer material, the hardened material being formed as a result of the replacement tubular undergoing a hardening process, thereby resulting in a hardened replacement tubular.

In another embodiment, the hardening process comprises at least one of a through wall heat treatment or a surface treatment such as a carburizing, nitriding, carbonitriding, flame hardening or chromizing process. Yet another comprises a surface enhancer on an outer surface of the hardened replacement tubular. In another, the surface enhancer is at least one of a friction-reducing material or an abrasion-resistant material. In yet another, a plurality of portions of the upper and lower portions of the drill pipe also comprise hardened material which is formed through the use of the hardening process. In another, an outer diameter of the replacement tubular is larger than an outer diameter of the upper and lower portions of the tubular body.

An alternative exemplary embodiment of the present invention provides a repaired drill pipe comprising: a first joint located on an upper end of the drill pipe; a second joint located on a lower end of the drill pipe; a tubular body extending between the first and second joints, the tubular body comprising: an upper portion extending beneath the first joint, the upper portion comprising an expanded lower end; a replacement tubular extending beneath the upper portion, the replacement tubular replacing a damaged section of the drill pipe; and a lower portion extending beneath the replacement tubular, the lower portion comprising an expanded upper end. Another embodiment further comprises a surface enhancer on an outer diameter of the replacement tubular.

In yet another, the replacement tubular comprises a hardened material which has undergone a hardening process, the hardening process being at least one of a through wall heat treatment or surface treatment such as a carburizing, nitriding, carbonitriding, flame hardening or chromizing process. Yet another further comprises a sleeve fixed atop an outer surface of the replacement tubulars. In another embodiment, the sleeve comprises a surface enhancer on an outer surface of the sleeve. In yet another, the surface enhancer comprises at least one of a friction-reducing or abrasion-resistant material. In another, an outer diameter of the replacement tubular is larger than an outer diameter of the expanded upper and lower ends of the upper and lower portions of the tubular body.

Although various embodiments and methodologies have been shown and described, the invention is not limited to such embodiments and methodologies and will be understood to include all modifications and variations as would be apparent to one skilled in the art. For example, downhole requirements may not necessitate use of a hardening process, expansion, and sleeve application in a single drill pipe. Rather, one or more methods may be utilized for any given section of drill pipe 10. Also, it may not be necessary, or desired, to apply a surface enhancement to the sleeve. Additionally, a sleeve could be applied to a drill pipe without performing any hardening process on the tubular. Moreover, the buckle and wear resistant technology described herein may be applied to tubulars and downhole tools other than drill pipe, as would be understood by one ordinarily skilled in the art having the benefit of this disclosure. Therefore, it should be understood that the invention is not intended to be limited to the particular forms disclosed. Rather, the intention is to cover all modifications, equivalents and alternatives falling within the spirit and scope of the invention as defined by the appended claims.

What we claim is:

1. A method of repairing a drill pipe having a tubular body extending between a first and second joint of the drill pipe, the method comprising the steps of:

(a) removing a damaged section of the tubular body;

(b) expanding a lower end of an upper drill pipe portion resulting from removal of the damaged section from the tubular body;

(c) expanding an upper end of a lower drill pipe portion resulting from removal of the damaged section; and (d) connecting a replacement tubular between the expanded upper and lower drill pipe portions.

2. A method as defined in claim 1, further comprising the step of hardening the replacement tubular.

3. A method as defined in claim 2, wherein the hardening process comprises at least one of a heat treatment, carburizing, nitriding, carbonitriding, flame hardening or chromizing process.

4. A method as defined in claim 2, further comprising the step of applying a surface enhancer on an outer surface of the hardened replacement tubular.

5. A method as defined in claim 4, wherein the surface enhancer is at least one of a friction-reducing material or an abrasion-resistant material.

6. A method as defined in claim 1, further comprising the step of affixing a sleeve atop the replacement tubular.

7. A method as defined in claim 1, wherein step (d) comprises the step of utilizing a clean induction welding method to connect the replacement tubular.

8. A method as defined in claim 1, wherein an outer diameter of the replacement tubular is larger than an outer diameter of the expanded upper and lower ends of the drill pipe portions.

9. A method as defined in claim 1, wherein connecting the replacement tubular between the upper and lower drill pipe portions comprises:

generating a weld between the replacement tubular and the lower end of the upper drill pipe portion or between the replacement tubular and the upper end of the lower drill pipe portion; and applying a tension force to the weld so that the weld has a wall thickness that approximates a thickness of the expanded lower end or the expanded upper end.

10. A method as defined in claim 9, wherein generating the weld comprises:

heating the replacement tubular and the lower end of the upper drill pipe portion or the upper end of the lower drill pipe portion to a desired temperature;

forcing together the replacement tubular and the upper drill pipe portion or the replacement tubular and the lower drill pipe portion and applying a rotation.

11. A method as defined in claim 1, wherein an inner diameter of the replacement tubular equals an inner diameter of the expanded lower end of the upper drill pipe portion.

12. A method as defined in claim 1, wherein the replacement tubular comprises the same material as that of the tubular body.

13. A repaired drill pipe comprising:

a first joint located on an upper end of the drill pipe, wherein the first joint comprises a threaded portion on an inner surface;

a second joint located on a lower end of the drill pipe, wherein the second joint comprises a threaded portion on an outer surface; and a tubular body extending between the first and second joints, the tubular body comprising:

an upper portion extending beneath the first joint, the upper portion comprising:

an original portion having an original inner diameter and an original outer diameter; and an expanded lower end having an expanded inner diameter larger than the original inner diameter and an expanded outer diameter larger than the original outer diameter;

wherein the original portion is above the expanded lower end;

a replacement tubular extending beneath the expanded lower end of the upper portion, the replacement tubular replacing a damaged section of the drill pipe; and a lower portion extending beneath the replacement tubular, the lower portion comprising an expanded upper end, wherein a portion of the replacement tubular comprises hardened material, while the first and second joints and the upper and lower portions of the drill pipe comprise a softer material, the hardened material being formed as a result of the replacement tubular undergoing a hardening process, thereby resulting in a hardened replacement tubular.

14. A repaired drill pipe as defined in claim 13, wherein the hardening process comprises at least one of a heat treatment, carburizing, nitriding, carbonitriding, flame hardening or chromizing process.

15. A repaired drill pipe as defined in claim 13, further comprising a surface enhancer on an outer surface of the hardened replacement tubular.

16. A repaired drill pipe as defined in claim 15, wherein the surface enhancer is at least one of friction-reducing material or an abrasion-resistant material.

17. A repaired drill pipe as defined in claim 13, wherein a plurality of portions of the upper and lower portions of the drill pipe also comprise hardened material which is formed through the use of the hardening process.

18. A repaired drill pipe as defined in claim 13, wherein an outer diameter of the replacement tubular is larger than an outer diameter of the upper and lower portions of the tubular body.

19. A repaired drill pipe as defined in claim 13, wherein the replacement tubular comprises the same material as that of the upper portion and the lower portion.

20. A repaired drill pipe as defined in claim 13, wherein an inner diameter of the replacement tubular equals the expanded inner diameter of the expanded lower end of the upper drill pipe portion.

21. A repaired drill pipe comprising:

a first joint located on an upper end of the drill pipe, wherein the first joint comprises a threaded portion on an inner surface;

a second joint located on a lower end of the drill pipe, wherein the second joint comprises a threaded portion on an outer surface;

a tubular body extending between the first and second joints, the tubular body comprising:

an upper portion extending beneath the first joint, the upper portion comprising:

an original portion having an original inner diameter and an original outer diameter;

an expanded lower end having an expanded inner diameter larger than the original inner diameter and an expanded outer diameter larger than the original outer diameter;

wherein the original portion is above the expanded lower end a replacement tubular extending beneath the expanded inner diameter of the upper portion, the replacement tubular replacing a damaged section of the drill pipe; and a lower portion extending beneath the replacement tubular, the lower portion comprising an expanded upper end beneath the replacement tubular.

22. A repaired drill pipe as defined in claim 21, further comprising a surface enhancer on an outer diameter of the replacement tubular.

23. A repaired drill pipe as defined in claim 21, wherein the replacement tubular comprises a hardened material which has undergone a hardening process, the hardening process being at least one of a heat treatment, carburizing, nitriding, carbonitriding, flame hardening or chromizing process.

24. A repaired drill pipe as defined in claim 21, further comprising a sleeve fixed atop an outer surface of the replacement tubulars.

25. A repaired drill pipe as defined in claim 24, wherein the sleeve comprises a surface enhancer on an outer surface of the sleeve.

26. A repaired drill pipe as defined in claim 25, wherein the outer surface of the sleeve comprises a hardened material which has undergone a hardening process.

27. A repaired drill pipe as defined in claim 25, wherein the surface enhancer comprises at least one of a friction-reducing or abrasion-resistant material.

28. A repaired drill pipe as defined in claim 21, wherein an outer diameter of the replacement tubular is larger than the expanded outer diameter corresponding to the expanded lower end of the upper portion of the tubular body.

29. A repaired drill pipe as defined in claim 21, wherein the replacement tubular comprises the same material as that of the upper portion and the lower portion.

30. A repaired drill pipe as defined in claim 21, wherein an inner diameter of the replacement tubular equals the expanded inner diameter of the upper drill pipe portion.

* * * * *